United States Patent [19]

Bloom et al.

[11] 4,311,944

[45] Jan. 19, 1982

[54] CRT WITH DIPOLAR DEFLECTION AND QUADRUPOLAR-FOCUSING COLOR-SELECTION STRUCTURE

[75] Inventors: Stanley Bloom, Bridgewater; Carmen A. Catanese, Rocky Hill, both of N.J.

[73] Assignee: RCA Corporation, New York, N.Y.

[21] Appl. No.: 163,724

[22] Filed: Jun. 27, 1980

[51] Int. Cl.[3] ..... H01J 29/80

[52] U.S. Cl. ..... 315/375; 313/403

[58] Field of Search ..... 315/374, 375; 313/402, 313/403, 408

[56] References Cited

U.S. PATENT DOCUMENTS 4,059,781 11/1977 Van Alphen et al. ..... 313/403

4,112,536 9/1978 Van Esdonk ..... 313/402

FOREIGN PATENT DOCUMENTS 2814391 10/1978 Fed. Rep. of Germany .

*Primary Examiner*—Theodore M. Blum

*Attorney, Agent, or Firm*—E. M. Whitacre; G. H. Bruestle; L. Greenspan

[57] ABSTRACT

A CRT comprises a deflection-and-focus color-selection masking structure, a screen of parallel phosphor stripes, and means for producing three convergent in-line electron beams directed towards the target. The masking structure comprises a metal masking plate having two major surfaces and having therein an array of apertures arranged in columns that are substantially parallel to the phosphor stripes. Arrays of narrow conductors are insulatingly supported in opposed positions on each major surface of said plate. The conductors extend substantially parallel to the stripes and are located in every other space between the columns.

10 Claims, 7 Drawing Figures

CRT WITH DIPOLAR DEFLECTION AND QUADRUPOLAR-FOCUSING COLOR-SELECTION STRUCTURE

BACKGROUND OF THE INVENTION

This invention relates to an improved focus-mask-type CRT (cathode-ray tube) and to a method for operating this improved CRT.

A commercial shadow-mask-type color television picture tube, which is a type of CRT, comprises generally an evacuated envelope having therein a target comprising an array of phosphor elements of three different emission colors arranged in cyclic order, means for producing three convergent electron beams directed towards the target, and a color-selection structure including an apertured masking plate between the target and the beam-producing means. The masking plate shadows the target and, therefore, is also called a shadow mask. The differences in convergence angles permit the transmitted portions of each beam, or beamlets, to select and excite phosphor elements of the desired emission color. At about the center of the color-selection structure, the masking plate of this commercial CRT intercepts all but about 18% of the beam currents; that is, the plate is said to have a transmission of about 18%. Thus, the area of the apertures of the plate is about 18% of the area of the mask. Since there are no focusing fields present, a corresponding portion of the target is excited by the beamlets of each electron beam.

Several methods have been suggested for increasing the transmission of the masking plate; that is, increasing the area of the apertures with respect to the area of the plate, without substantially increasing the excited portions of the target area. In one approach, the apertures are arranged in columns opposite substantially parallel phosphor stripes in the target. Each aperture in the masking plate is enlarged and split into two adjacent windows by a conductor. The two beamlets passing through adjacent windows are deflected towards one another, and both beamlets fall on substantially the same area of the target. In this approach, the transmitted portions of the beams are also focused in one transverse direction and defocused in the orthogonal transverse direction.

One family of CRTs employing such a combined deflection-and-focus color-selection means includes, as normally viewed, a target comprised of a mosaic of vertical phosphor stripes of three different emission colors arranged cyclically in triads (groups of three different stripes), means for producing three convergent horizontally in-line electron beams directed towards the target, and a color-selection structure located adjacent and closely spaced from the target. The color-selection structure comprises a metal-masking plate having therein an array of substantially rectangular apertures arranged in vertical columns and a single array of narrow vertical conductors in the form of wires insulatingly spaced and supported from one major surface of the masking plate, with each wire conductor substantially centered over the apertures of one of the columns of apertures. Each wire conductor is unsupported and uninsulated over each aperture. Viewed from the electron-beam-producing means, the conductors divide each aperture into two essentially-equal horizontally-coadjacent windows.

When operating this latter device, the narrow vertical conductors are electrically biased with respect to the masking plate, so that the beamlets passing through each of the windows of the same aperture are deflected horizontally toward the positively-biased side of the window. Simultaneously, because of quadrupole-like focusing fields established in the windows, the beamlets are focused (compressed) in one direction of the phosphor stripes and defocused (stretched) in the other direction of the phosphor stripes. The spacings and voltages are so chosen to form an array of electrostatic lenses that also deflects adjacent pairs of beamlets to fall on the same phosphor stripe of the target. The convergence angle of the beam that produces the beamlet determines which stripe of the triad is selected.

This color-selection structure requires electrical insulation between the masking plate and the wire conductors that comprise the color-selection structure. In such structures that have been made up to the present, some insulation is left, after all fabricating processes have been completed, in positions where it is exposed to electron bombardment. This bombardment electrostatically charges surfaces of the insulator with a resultant severe distortion of the final beam spot. Although heroic measures, such as sandblasting and spot-knocking, achieve some success in removing exposed insulation, these are not practical, large-scale remedies for mass producing this structure.

SUMMARY OF THE INVENTION

The novel CRT employs a deflection-and-focus color-selection structure and a screen comprised of parallel phosphor stripes. Unlike the above-described prior CRT, the novel CRT employs a color-selection structure in which the single array of wire conductors that is unsupported as it passes over the apertures is replaced with an array of narrow conductors insulatingly supported in opposed positions on each major surface of said plate and extending substantially parallel to the phosphor stripes. Since a portion of the plate is under each of the conductors on opposite sides of the plate, the conductors are supported on the plate in the spaces between every other one of the columns.

The present invention surmounts the insulation-charging by (a) superposing one electrode system on top of the other so as to physically shield the entire insulation layer and by (b) placing the superposed electrodes symmetrically on both the front and back faces of the mask so as to electrically shield the underlying substrate electrode. This electrical shielding effect is crucial; without it, approximately twice as large a voltage difference would have to be applied, resulting in a danger of field breakdown across the insulators.

The novel CRT includes (a) a target comprising an array of subtantially parallel stripes of three different emission colors arranged in cyclic order in adjacent triads, each triad comprising a stripe of each of the three different emission colors, (b) means for producing three convergent in-line electron beams directed towards the target in a plane that is substantially normal to the length of the phosphor stripes, and (c) a color-selection structure positioned between the target and beam-producing means. The color-selection structure comprises (i) a metal masking plate having two opposed major surfaces and having therein an array of apertures arranged in columns that are substantially parallel to the length of said phosphor stripes, and (ii) an array of narrow conductors insulatingly supported in opposed positions on each major surface of said plate. The conductors, which extend substantially parallel to the length of said stripes and are supported on the plate in every other space between said columns, are positioned to shield the insulating supports for the conductors from electrostatic charging.

DETAILED DESCRIPTION OF THE PREFERRED EMBODIMENT

Figure 1:
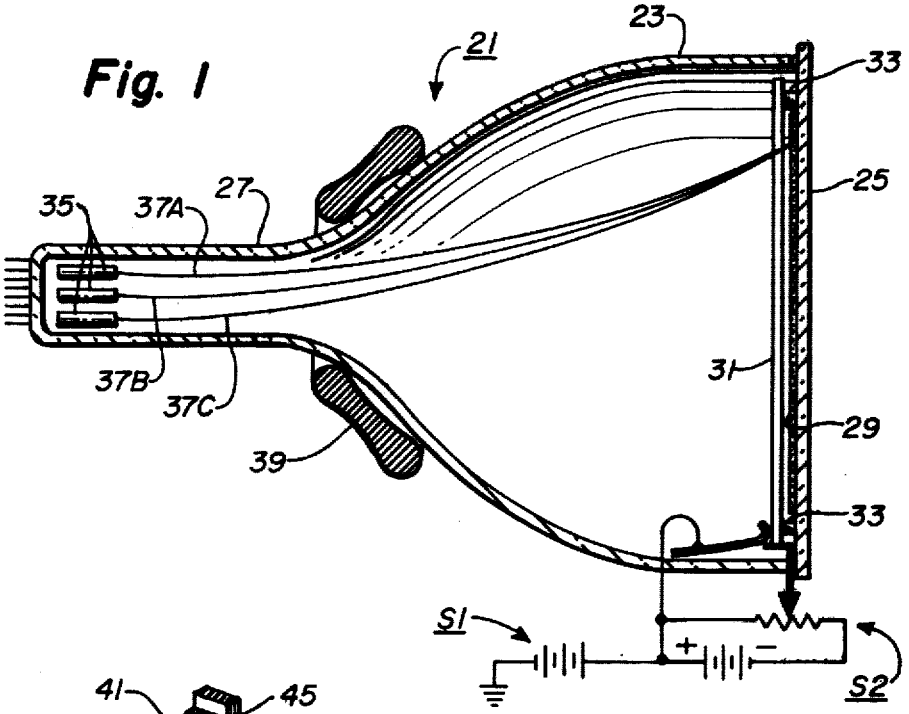
FIG. 1 is a partially-schematic sectional top view of an embodiment of a novel CRT.

The novel color television picture tube 21 shown in FIG. 1 comprises an evacuated bulb 23 including a transparent faceplate 25 at one end and a neck 27 at the other end. The faceplate 25, which is flat, but may arch or dome outwardly, supports a luminescent viewing screen or target 29 on its inner surface. Also, a color-selection structure 31 is supported from three supports 33 on the inside surface of the faceplate 25. Means 35 for generating three electron beams 37A, 37B and 37C are housed in the neck 27. The beams are generated in substantially a plane, which is preferably horizontal in the normal viewing position. The beams are directed towards the screen 29 with the outer beams 37A and 37C convergent on the center beam 37B at the target 29. The three beams may be deflected with the aid of a deflection coil 39 to scan a raster over the color-selection structure 31 and the viewing screen 29.

Figure 2:
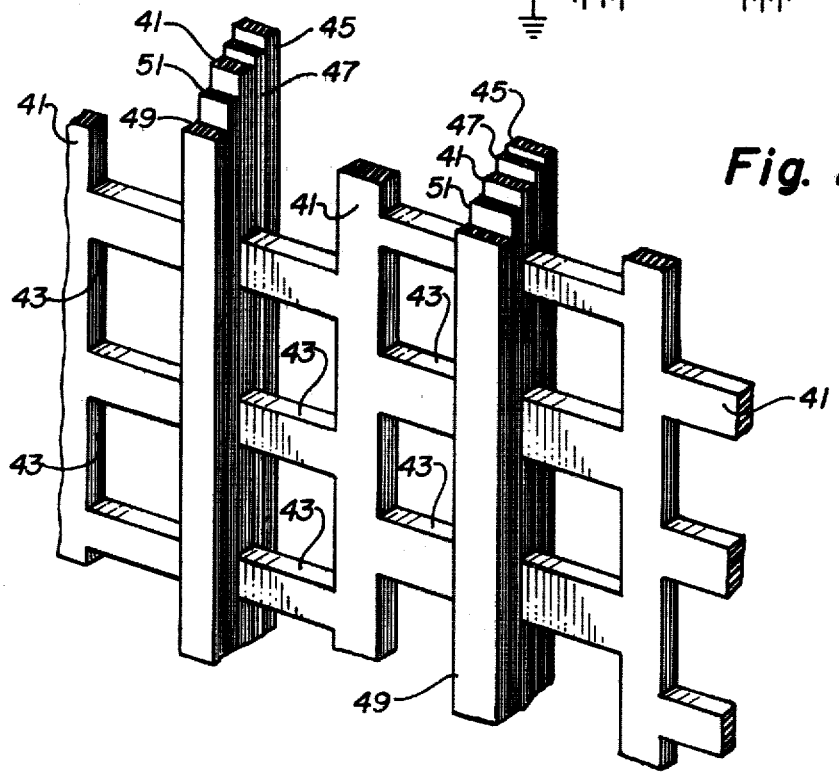
FIG. 2 is a perspective view and FIG. 3 is a front view of a fragment of the color-selection structure of the novel CRT shown in FIG. 1 including a masking plate have substantially rectangular apertures therein arranged in vertical columns but with the apertures of one pair of columns offset from the apertures of an adjacent pair of columns in the vertical direction.
Figure 3:
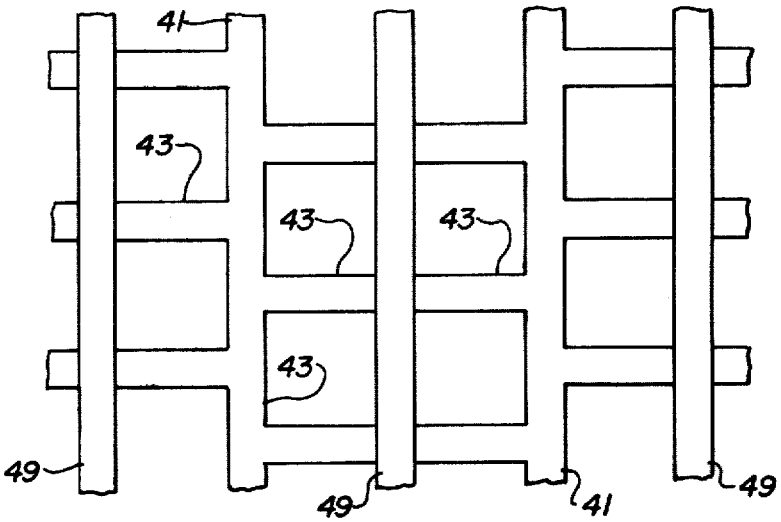
Figure 6:
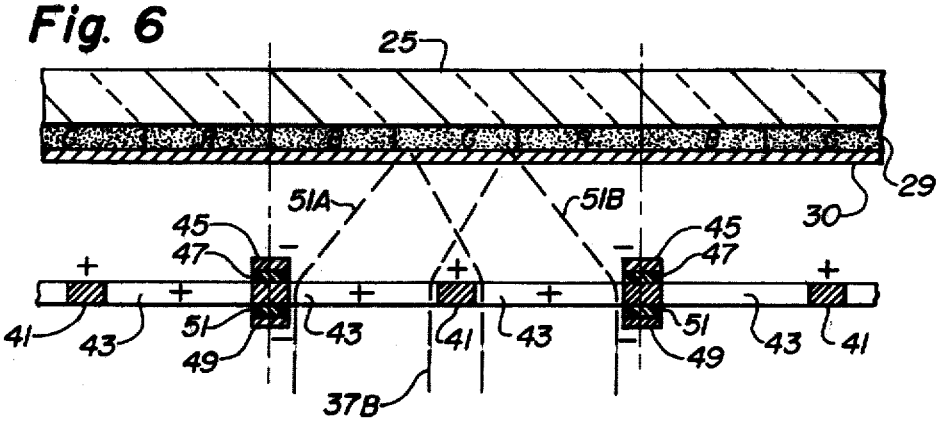
FIG. 6 is a sectional view through any of the embodiments of FIGS. 2 to 5 illustrating the operation of the novel CRT wherein the narrow conductors are negatively biased relative to the masking plate.

The viewing screen 29 and the color-selection structure 31 are described in more detail with respect to FIGS. 2, 3 and 6. The viewing screen 29 (FIG. 6) comprises a large number of red-emitting, green-emitting and blue-emitting phosphor stripes R, G and B respectively arranged in color groups of three stripes or triads in a cyclic order and extending in a direction which is generally normal to the plane in which the electron beams are generated. In the normal viewing position for this embodiment, the phosphor stripes extend in the vertical direction.

The color-selection structure 31 comprises a masking plate 41 having a large number of rectangular openings or apertures 43 therein. The apertures 43 are arranged in vertical columns, which are parallel to the long direction of the phosphor stripes R, G and B, there being two adjacent columns of apertures associated with each triad of stripes. The green stripe is at the center of each triad, and, is centered over the space between its associated pair of columns of apertures. The red stripe R is to the right and the blue stripe B is to the left of the green stripe G as viewed from the electron-beam-producing means 35. A first array of narrow first conductors 45 is closely spaced from the screen side of the masking plate 41 by first insulators 47 that are about 0.025 mm (1mil) thick. A first conductor 45 extends down every other space between the columns of apertures 43 on the screen side of the masking plate 41 and opposite each triad boundary; that is, centered opposite the boundry between the red and blue stripes R and B. A second array of narrow second conductors 49 is closely spaced from the beam-producing side of the plate 41 by second insulators 51 that are about 0.025 mm (1 mil) thick. A second conductor 49 extends down every other space between the columns of apertures 43 opposite each first conductor. The conductors 45 and 49 are substantially parallel to the stripes R, G and B. The apertures 43 are functionally electron-transmitting parts or windows.

In this first embodiment, the apertures 43 at the center of the plate 41 are about 0.31 mm (12 mils) wide by 0.31 mm (12 mils) high. The apertures are spaced about 0.11 mm (4 mils) apart from adjacent apertures above and below. To the sides, the spacing is about 0.11 mm (4 mils). The conductors are about 0.15 mm (4 mils) wide. The masking plate 41 is spaced about 12.7 mm (540 mils) from the phosphor stripes, R, G and B.

Figure 4:
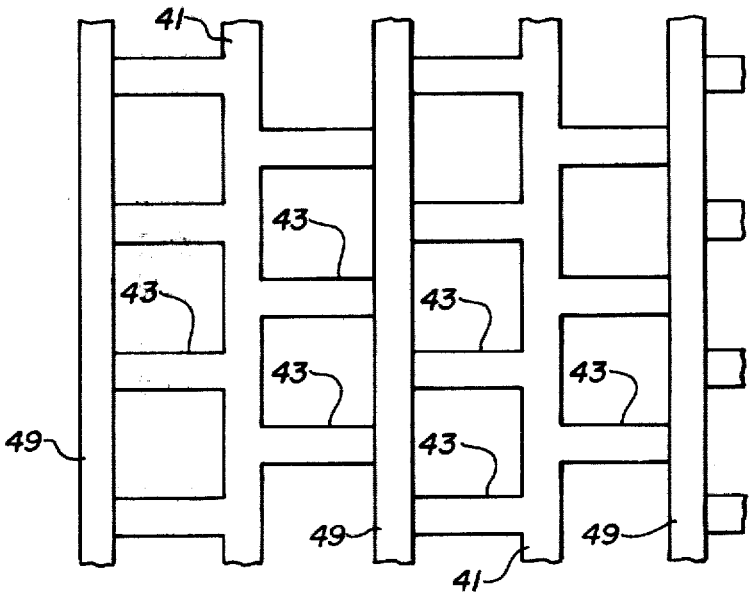
FIG. 4 is a front view of a fragment of a second color-selection structure for an alternative embodiment of a novel CRT including a masking plate having rectangular apertures therein arranged in vertical columns but with the apertures in adjacent columns offset from one another in the vertical direction.
Figure 5:
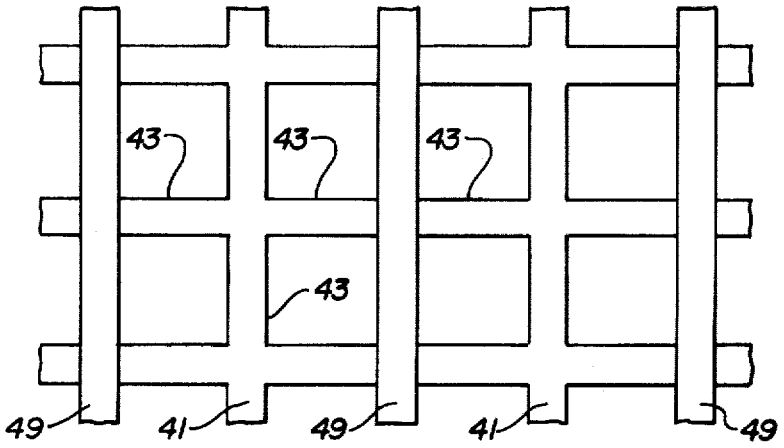
FIG. 5 is a front view of a fragment of a third color-selection structure for another embodiment of the novel CRT including a masking plate having substantially rectangular apertures therein arranged in vertical columns and horizontal lines.

All of the sizes are exemplary and may be varied. The apertures 43 are uniformly sized but may be, if desired, graded in size from the center to the edge of the masking plate 41. Also, the spacing between the masking plate 41 and the stripes R, G and B is uniform but may be graded from the center to the edge of the masking plate 41. As another alternative, the apertures 43 in adjacent columns may be vertically offset from one another as shown in FIG. 4, or may be in horizontal lines and vertical rows as shown in FIG. 5. To improve the light output of the target, the surfaces of the stripes R, G and B towards the electron-producing means may be coated with a light-reflective electron-permeable material, such as aluminum metal 30 as is known in the art.

To operate the tube 21 of this first embodiment (FIGS. 2 and 6), the electron-beam-producing means 35 is energized with the cathode at essentially ground potential. A first positive voltage (V) of about 25,000 volts from a voltage source S1 is applied to the screen and to the masking plate 41, and a second positive voltage ($V-\Delta V$) of about 25,000 volts minus about 200 volts from a source S2 is applied to each of the first and second conductors 45 and 49. Three convergent beams 37A, 37B and 37C from the electron-beam-producing means 35 are made to scan a raster on the viewing screen 29 with the aid of the deflection coils 39. The beams approach the masking plate at different but definite angles. Each beam is much wider than the apertures and therefore spans many apertures. Each beam produces many beamlets, which are the portions of the beam which pass through the apertures.

Electrostatic dipolar and quadrupolar fields are produced in each aperture 43 by the difference in the voltages applied to the plate 41 and the conductors 45 and 49. The electrostatic dipolar fields cause those beamlets that pass through the apertures 43 to be deflected away from the conductors 45. The quadrupolar fields focus the beamlets normal to the length direction of the conductors 45 and 49, so that the beamlets are compressed in that direction. The electrostatic fields produced by the voltage on the plate 41 are masked where the conductors 45 and 49 overlay the plate 41. However, where the plate 41 is not overlaid by the conductors 45 and 49, the field produced by the voltage on the plate defocuses the beamlet parallel to the direction of the conductors 45 and 49 so that the beamlets are expanded in that direction. Because of the spacing between the masking plate 41 and the stripes R, G and B in combination with the different convergent angles, adjacent beamlets from adjacent pairs of apertures 43 between the conductors 45 fall on the same phosphor stripe in overlapping fashion. For example, as shown in FIG. 6, the center beam 37B typically produces pairs of adjacent beamlets 51A and 51B which pass through adjacent apertures 43 which are deflected to fall on a green-emitting stripe G. The same deflection and focusing occurs at each pair of adjacent apertures 43 as the center beam 37B scans across the viewing screen 29. Similarly, but at a different angle, one side beam 37A produces two adjacent beamlets (not shown) from adjacent apertures which fall on the same red-emitting stripe R; and the other side beam 37C produces two adjacent beamlets (not shown) from adjacent apertures which fall on the same blue-emitting stripe B.

Figure 7:
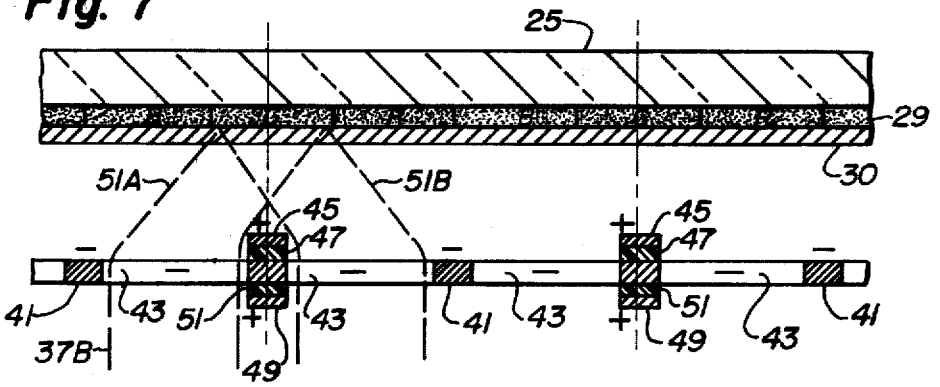
FIG. 7 is a perspective view through any of the embodiments of FIGS. 2 to 5 illustrating the novel CRT wherein the narrow conductors are positively biased relative to the masking plate.

A second embodiment of the novel tube shown in FIG. 1 also employs the mask shown in FIG. 2. However, in this second embodiment as shown in FIG. 7, the phosphor stripes R, G and B that comprise the target 29 are displaced half a triad width so that the conductors 45 and 49 are about centered on the green-emitting stripe G. To operate the tube 21 of this second embodiment, the electron-beam-producing means 35 is energized from the sources S1 and S2 as in the first embodiment. A first positive voltage (V) of about 25,000 volts from a voltage source S1 is applied to the screen and to the masking plate 41. A second positive voltage ($V+\Delta V$) of about 25,000 volts plus about 200 volts from a source 52 is applied to each of the first and second conductors 45 and 49. Three convergent beams 37A, 37B and 37C from the electron-beam-producing means 35 are made to scan a raster on the viewing screen 29 as in the first embodiment.

Electrostatic dipolar and quadrupolar fields are produced at each aperture 43 by the difference in the voltages applied to the plate 41 and the conductors 45 and 49. The electrostatic dipolar fields cause those beamlets that pass through the apertures 43 to be deflected towards (instead of away from) the conductors 45. The quadrupolar fields focus the beamlets parallel to the length direction of the conductors 45 and 49 and defocus the beamlets normal to the length direction of the conductors 45 and 49.

Because of the spacing between the masking plate 41 and the stripes R, G and B in combination with the different convergent angles, adjacent beamlets from adjacent pairs of apertures 43 on each side of the conductors fall on the same phosphor stripe in overlapping fashion. For example, as shown in FIG. 7, the center beam 37B typically produces pairs of adjacent beamlets 51A and 51B which pass through adjacent apertures 43 and are deflected to fall on a green-emitting stripe G. The same deflection and focusing occur at each pair of adjacent apertures 43 as the center beam 37B scans across the viewing screen 29. Similarly, but at a different angle, the two side beams 37A and 37C selectively excite the red-emitting and blue-emitting stripes respectively as in the first embodiment.

We claim:

1. In a cathode-ray tube including (a) a target comprising an array of substantially parallel phosphor stripes of three different emission colors arranged in cyclic order in adjacent triads, each triad comprising a stripe of each of said three different emission colors, (b) means for producing three convergent in-line electron beams directed towards said target in a plane that is substantially normal to the lengths of said stripes, and (c) a color-selection structure positioned between said target and said beam-producing means, said structure comprising (i) a metal masking plate having two opposed major surfaces and having therein an array of apertures arranged in columns that are substantially parallel to said phosphor stripes, and (ii) a first array of narrow conductors insulatingly supported from one major surface of said plate and extending substantially parallel to the lengths of said stripes, with a conductor being supported on said plate in every other space between said columns, said masking plate and said conductors defining an array of windows for transmitting therethrough portions of said electron beams, the improvement comprising (iii) a second array of narrow conductors insulatingly supported from the other major surface of said plate, each conductor of said second array being opposite and spaced from a conductor of said first array.

2. The tube defined in claim 1 wherein each of said conductors is opposite and spaced from about the boundary between adjacent triads.

3. The tube defined in claim 1 wherein each of said conductors is opposite and spaced from about the center between the boundaries of a triad.

4. The tube defined in claim 1 wherein said apertures are arranged in vertical columns and horizontal lines as said target is normally viewed.

5. The tube defined in claim 1 wherein said apertures are arrange in vertical columns, and apertures of adjacent columns are offset from one another as said target is normally viewed.

6. The tube defined in claim 1 wherein said apertures are arranged in vertical columns and apertures in adajcent pairs of columns are aligned horizontally with one another and horizontally-adjacent pairs of apertures are offset from one another.

7. The tube defined in claim 1 including means for applying to said masking plate a positive voltage relative to said electron-beam-producing means, which voltage is operative to accelerate said beams towards said target, and means for applying to said conductors a negative voltage relative to the voltage on said masking plate, which negative voltage is operative to deflect electron beamlets that are transmitted through said windows incident upon selected ones of said phosphor stripes.

8. The cathode-ray tube defined in claim 1 including means for applying to said masking plate a positive voltage relative to said electron-beam-producing means, which voltage is operative to accelerate said beams towards said target, and means for applying to said conductors a positive voltage relative to the voltage on said masking plate, which latter positive voltage is operative to deflect electron beamlets that are transmitted through said windows incident upon selected ones of said phosphor stripes.

9. In a cathode-ray tube including (a) a target comprising an array of phosphor elements of different emission colors arranged in cyclic order in adjacent color groups, each group comprising an element of each of said different emission colors, (b) means for producing a plurality of convergent electron beams directed towards said target, and (c) a color-selection structure positioned between said target and said beam-producing means, said structure having a plurality of means for transmitting portions of said beams to associated color groups and means for focusing and deflecting said beam portions, said color-selection structure comprising (i) a metal masking plate having two opposed major surfaces and having therein an array of substantially rectangular windows arranged in adjacent pairs thereof, and associated therewith, (ii) a first array of narrow conductors insulatingly spaced from one major surface of said plate, there being a conductor located between the windows of each of said pairs of windows, the improvement wherein said structure includes (iii) a second array of narrow conductors insulatingly spaced from the other major surface of said plate and located opposite conductors of said first array.

10. The cathode-ray tube defined in claim 9 wherein the portions of opposed conductors between adjacent pairs of windows are insulatingly supported from portions of said masking plate therebetween.

* * * * *